US005495900A

United States Patent [19]

Falgout, Sr.

[11] Patent Number: 5,495,900

[45] Date of Patent: Mar. 5, 1996

[54] DRILL STRING DEFLECTION SUB

[76] Inventor: Thomas E. Falgout, Sr., 110 Charles Read St., Lafayette, La. 70503

[21] Appl. No.: 267,563

[22] Filed: Jun. 29, 1994

[51] Int. Cl.[6] ..... E21B 7/08

[52] U.S. Cl. ..... 175/74; 175/101; 175/107; 175/325.2

[58] Field of Search ..... 175/73–75, 61, 175/101, 107, 325.2

[56] References Cited

U.S. PATENT DOCUMENTS

| | | | |
|---|---|---|---|
| Re. 29,526 | 1/1978 | Jeter | 175/61 X |
| 4,286,676 | 9/1981 | Nguyen et al. | 175/74 |
| 4,596,294 | 6/1986 | Russell | 175/317 X |
| 4,655,299 | 4/1987 | Schoeffler | 175/38 |
| 4,811,798 | 3/1989 | Falgout, Sr. | 175/73 |
| 5,117,927 | 6/1992 | Askew | 175/325.2 X |
| 5,168,943 | 12/1992 | Falgout, Sr. | 175/74 |
| 5,368,111 | 11/1994 | Benoit et al. | 175/256 X |

*Primary Examiner*—Roger J. Schoeppel
*Attorney, Agent, or Firm*—John D. Jeter

[57] ABSTRACT

A deflection control sub to be used with or as part of a down hole drilling motor, is a drill string element consisting of an upper and a lower portion connected by bearings for relative rotation about an axis that is not parallel to the axes of the two portions. When assembled ,and in the straight configuration the bearing axis has about a two degree angle relative to the other two axes. When one portion is rotated relative to the other one half turn, the axes of opposite ends of the sub are deflected about four degrees. The actual amount is a designers choice, and deflects the axis of an associated drill string that amount within the sub. The sub portions are rotated relative to each other by a drilling fluid powered motor in response to drilling fluid pressure difference between a fluid channel extending through the sub and the annulus outside the sub. A spring biases the opposite ends to rotate to the straight configuration until the motor overcomes the spring to deflect the axis. Options include two forms of deflection motor disablers which respond to different mud flow rate controls. A further option includes a signal valve operated by the moving motor to briefly produce a pressure pulse detectable at the surface to indicate that the sub is changing configuration.

17 Claims, 3 Drawing Sheets

DRILL STRING DEFLECTION SUB

This invention pertains to apparatus usable to deflect the drill string to influence the course of a well bore being drilled. More particularly it is to be used for drilling with down hole motors. Featured are means to change the down hole assembly between straight drilling and directional drilling configurations. The configuration choices are determined by actions of the driller in choosing the nature and timing of manipulations of conventional drilling controls at the surface.

BACKGROUND OF THE INVENTION

Directional drilling in the early stages of petroleum drilling development was practiced in unusual situations and only those skilled in that particular art were in control of drilling operations for the directional controlling activity. As the drilling art became more professional, and more technical support developed, the trend was toward more complex and responsive down hole drilling apparatus to reduce the skill requirements on the drilling floor. Additionally, well bore survey equipment improved and measurement while drilling became practical. The driller could determine what was taking place down hole every few feet and less risk was involved in making drilling technique decisions. Simple actions on the part of the driller could dictate configuration of the down hole apparatus and effective down link command became a reality. The thrust of current development is directed to making the responsive down hole directional drilling control apparatus more simple and economical to build and maintain.

It is therefore an object of this invention to provide apparatus to be used with a down hole motor, responsive to manipulations of the surface drilling controls, to change the down hole assembly between the straight drilling configuration and the directional drilling configuration.

It is another object of this invention to provide apparatus that can be attached to, or be made part of, the drilling motor housing to accomplish the configuration change within, the motor body.

It is yet another object to provide means to respond to selective surface drilling fluid flow controls to disable the deflection means to enable drilling with the sub in the straight configuration.

It is still a further object of this invention to provide a combination of means for responding to down link commands produced by exercise of surface mud pump controls to control down hole configuration change to enable a combination of deflection subs to be used independently in a down hole drilling assembly.

It is still another object of this invention to provide apparatus to respond to brief intervals of reverse mud circulation to manipulate the deflection controls down hole.

It is still a further object to provide a signal valve responsive to the change in configuration of the sub to produce a drilling fluid pressure pulse detectable at the surface to indicate that configuration change is taking place down hole.

These and other objects, advantages, and features of this invention will be apparent to those skilled in the art from a consideration of this specification, including the attached claims and appended drawings.

SUMMARY OF THE INVENTION

A deflection sub adapted for use as a length of drill string has a generally tubular body of two principal parts bearingly joined for relative rotation with an arbor on one extending into a bore in the other. The axis of both arbor and bore is about equally deflected relative to the major axes of both parts. At one point of relative rotational positioning the major axes are parallel and for all practical purposes the sub can be considered straight and a drill string continuing from each end will not be deflected. If one end of the sub is rotated one half turn relative to the other end the sub overall axis will be deflected an amount twice the amount of deflection of the bore relative to the major axes of the parts. Relative rotation of less than one-half turn produces a correspondingly lesser deflection. Rotation of one end relative to the other is caused by drilling fluid pressure that moves a piston in the sub which moves a spiral spline axially relative to an axially stationary follower to convert axial to rotary motion. The piston is, optionally, spring biased to the original position and the sub is returned to the straight position by that spring action when drilling fluid flow is reduced below a preselected amount. The sub has a channel along the general centerline to conduct drilling fluid between attached upwardly and downwardly continuing drill string components. That bore can be used for the drive shaft of a drilling motor and makes it practical to use the sub as part of the drilling motor body.

Optional features include a mud pressure operated time delay lock which allows the tool to be locked in the straight configuration if fluid flow is started at a rate between that required to start the time run on the lock and that required to actuate the deflection feature of the sub. After a preselected time at that rate the lock actuates to inhibit movement of the deflection feature at any flow rate. Drilling can then proceed with a straight assembly. Drilling fluid flow advanced directly to a rate that actuates the deflection feature before the lock times out makes the lock itself ineffective permitting the sub to go to the deflected configuration for drilling as long as fluid flow proceeds above a preselected rate.

Another option includes a turnstile device that is rotated by axial movement of the piston. Each forward and back excursion the piston rotates the turnstile one increment of revolution. On some excursions of the piston the turnstile stops it after a ,short distance. On other excursions, the piston is allowed to go to the limit of travel that actuates the deflection apparatus. Preferably, on odd numbered excursions deflection is permitted. Even excursions would provide configuration for straight drilling.

A further optional feature provides a mud pressure fluctuation signal when the deflection feature actuates. The actuation piston is annular with a central channel that conducts the flow pumped down the drill string bore. The piston moves axially and an orifice in the channel is allowed to move past a cooperating partial plug to yield a brief pressure pulse in the drilling fluid stream that is detectable at the surface.

BRIEF DESCRIPTION OF DRAWINGS

In the drawings, wherein like features have the same captions.

DETAILED DESCRIPTION OF DRAWINGS

Figure 1:
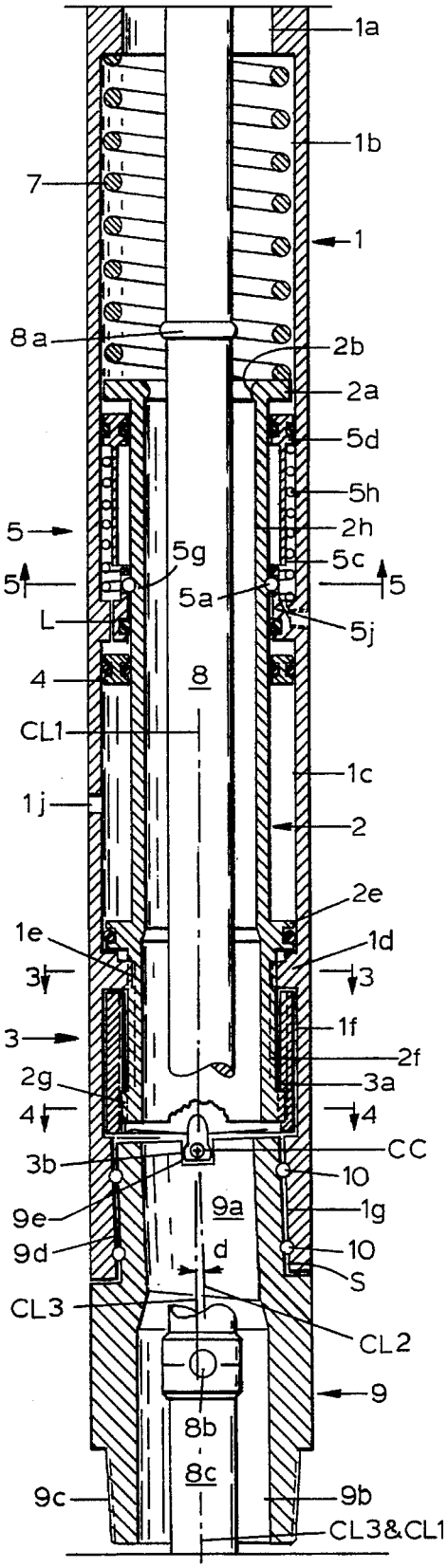
FIG. 1 is a longitudinal section of the preferred embodiment in the straight configuration.

In the drawings certain features, well established in the art and not bearing upon points of novelty, have been omitted in the interest of clarity and descriptive efficiency. Such features may include weld lines, threaded fasteners, and threaded connections between some associated parts.

Figure 2:
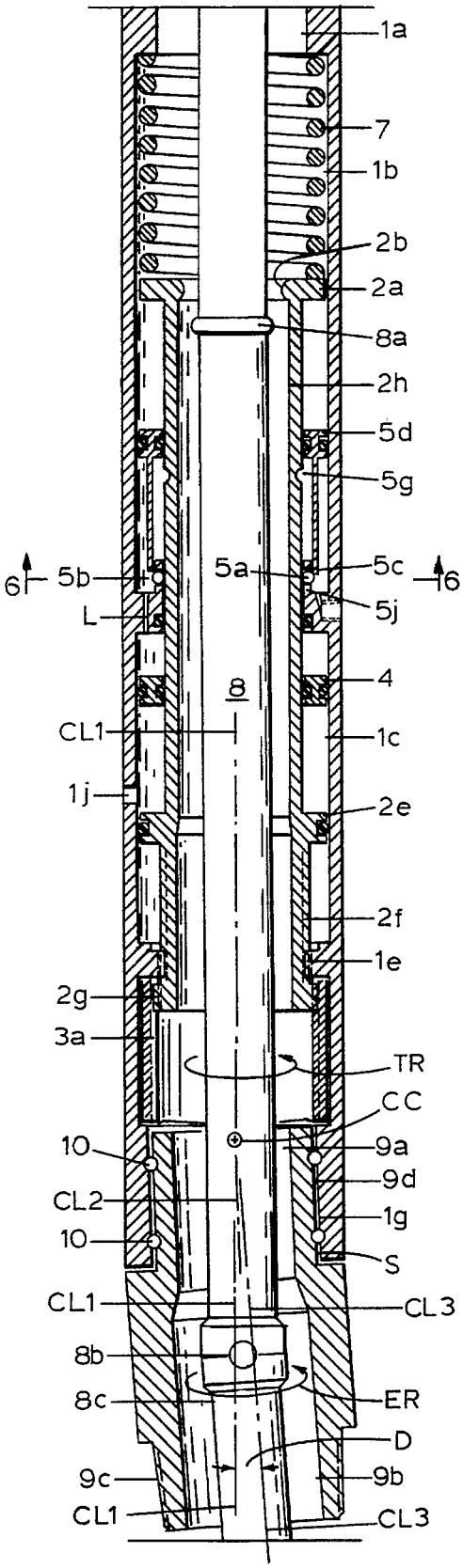
FIG. 2 is a section similar to FIG. 1 but actuated to the deflected configuration.

FIGS. 1 and 2 are side views, mostly cut away, of the preferred embodiment in the straight and deflected configurations respectively. The body comprised of body portion 1 and body extension 9 with the associated fluid channels comprises a length of drill string. The lower tool joint 9*c* attaches with fluid tightness to a downwardly continuing portion of a drill string. A similar upper tool joint is not shown but is, preferably, quite similar to the 9*c* version and attaches with fluid tightness to an upwardly continuing portion of a drill string. If the apparatus is part of a drilling motor body, the motor drive shaft 8 passes along the central channel as shown.

Deflection is achieved by rotation of extension 9 relative to the portion 1 about center line CL2 which is tilted relative to the longitudinal axis CL1 of portion 1 and axis CL3 of the extension 9 and lower tool joint 9*c*. Extension 9 rotates on bearings 10 which support arbor 9*d*. Extension 9 is rotated by turret 3 by way of tang 3*b* in socket 9*e*. There are two tangs and two sockets diametrically separated to provide the effect of a tubular universal joint near the point where CL2 intersects CL1 and CL3. Ref. CC denotes the point of centerline convergence. The reference d is the angular deflection between CL2 and the other two lines CL1 and CL3. The reference D is the drill string deflection and is twice d, in the preferred embodiment, at maximum deflection. Turret 3 is rotated by spiral spline 3*a* in cooperation with drive spline 2*g* which is moved axially by mud pressure and retained rotationally by spline 2*f* in cooperation with drive spline 1*e*. Arrow TR indicates rotation of turret 3 and arrow ER indicates consequent rotation of extension 9, driven by way of tang 3*b* and socket 9*e*. The spline system is shown enlarged in FIGS. 3 and 4.

Assembly 2 is effectively a wash pipe and differential piston integrated into a spiral splined linear to rotary movement converter. All of assembly 2 is exposed to essentially the same pressure except the region sealed against portion 1 at two different diameters by piston 2*e* and gland flange 5*j*. The differential piston force can be multiplied by axially spaced repeats of the flange and piston arrangement, with added ports 1*j*, to provide tandem power cylinders. Assembly 2, turret 3 and related splines comprise a hydraulic motor. A mud pressure difference between the general mud channel 9*a* and the annulus outside the enclosure urges piston 2*e* toward opening 1*j*. When mud pressure rises enough for piston 2*e* to overcome spring 7, the assembly 2 moves upward rotating turret 3 in the process. Turret 3 has tang 3*b* in socket 9*e* to compel sympathetic rotation of extension 9. Extension 9 rotates about deflected center line CL2. This center line has about the same angle between CL1 and CL3, the latter two, in the FIG. 1 configuration, being effectively coaxial. The center line CL2 is shown to be deflected two degrees from CL1 and CL3. When extension 9 is rotated one-half turn, the deflections are cumulative and CL3 is then deflected four degrees from CL1. The angles between center lines is a designers option.

When drilling fluid (mud) pressure is reduced below a preselected value spring 7 overcomes piston 2*e* and assembly 2 moves downward, rotating turret 3 and extension 9 back to the straight configuration of FIG. 1. By choice of direction of spiral 3*a* the recovery direction of rotation of extension 9 can be counter clockwise viewed from the top end. With that arrangement the drill string normal rotation will assist recovery due to well bore wall drag below axis CL2.

All pistons shown are positively sealed in the drawing and in practice. The closure between portion 1 and extension 9 may be related to a motor body downstream of the power producing motor. Sealing there may be by labyrinth or it may be positively sealed and is captioned S to indicate some degree of closure.

Drive shaft 8 will be present if the use is in a motor body. Some motors have shafts that do not stay concentric with the body and must be free to oscillate within a bore. Flex joint 8*b* is symbolically shown and is accommodated within opening 9*b*. Some motor shafts merely strain to accept the oscillating displacement and axis deflection, if present. The accommodating bore 2*h* is anticipated by the claims but the shaft itself is not part of this invention. The bulge 8*a* will be explained later as part of an optional signal valve but that use is a matter of convenience, when present, as a valve element support member suspended within the body portion.

Optional features include a signal valve to cause a pressure pulse in the mud stream when assembly 2 moves, to actuate the apparatus to the deflected state, and bulge 8*a* passes through orifice 2*b*. That is a resistance change, not a valve closure, and the bulge 8*a* does not have to be concentric with orifice 2*b*. A brief pressure change in the mud stream at the surface is detectable to indicate actuation.

Optional also is a timer feature that permits drilling in the straight configuration by locking assembly 2 before sufficient pressure is applied to move piston 2*e*. Annular pistons 4 and 5*d* provide an oil filled annular enclosure. When mud pressure exists in opening 1*b*, higher than that at port 1*j*, the two pistons 4 and 5*d* are urged to move downward at a rate permitted by preselected leak L. Spring 5*h* urges piston 5*d* upward to flange 2*a* when there is no mud flow. A mud flow too low to overcome spring 7 will overcome spring 5*h*. Spring 5*h* is omitted from FIG. 2 in the interest of clarity of that area of the drawing. Given time, lock skirt 5*c* will engage balls 5*a* and restrain them in groove 5*g* and no greater pressure can move assembly 2 upward and drilling fluid flow rate can be established without apparatus deflection. If mud pressure is initiated more rapidly, assembly 2 will start moving and urge balls 5*a* outward in radial bores 5*b* before the lock has time to actuate. When lock skirt 5*c* arrives at the lock balls, they block further movement of the skirt and no locking action takes place. Drilling then proceeds in the deflected state until mud pressure is reduced below a preselected amount.

Figure 3:
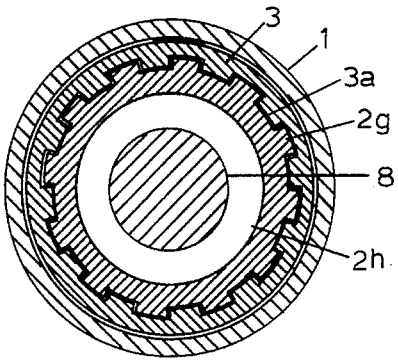
FIG. 3 is a cross section, somewhat enlarged, taken along line 3—3.
Figure 4:
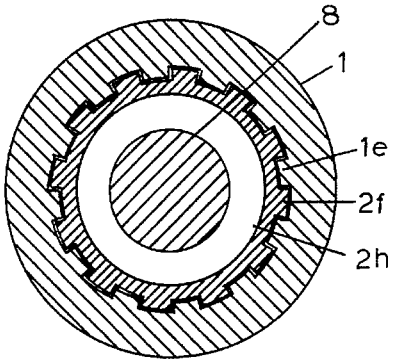
FIG. 4 is a cross section, somewhat enlarged, taken along line 4—4.

FIGS. 3 and 4 more clearly show the linear to rotary conversion means. To function, spline pair 3*a* and 2*g* and pair 1*e* and 2*f* need only to differ in helical pitch. By preference, pair 2*f* and 1*e* are straight, or axial, to avoid rotating piston 2*e*.

Figure 5:
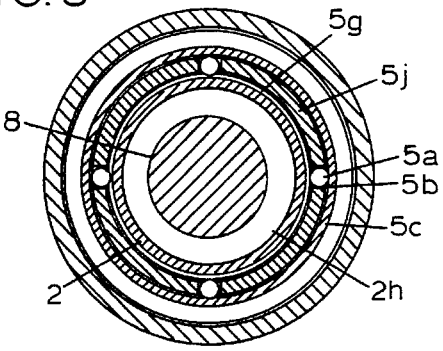
FIG. 5 is a cross section, somewhat enlarged, taken along line 5—5.
Figure 6:
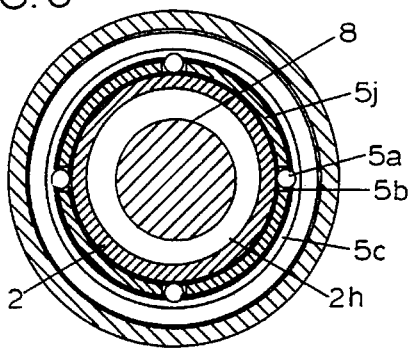
FIG. 6 is a cross section somewhat enlarged, taken along line 6—6.

FIGS. 5 and 6 show more detail of the optional lock 5. FIG. 5 differs from the line 5—5 condition of FIG. 1 in that piston 5*d* has just begun to move down in FIG. 1 and skirt 5*c* has not reached the locked position over the balls 5*a*. FIG. 5 shows the skirt moved to lock the balls into groove 5*g* and to inhibit upward movement of assembly 2, disabling the deflection means.

Figure 7:
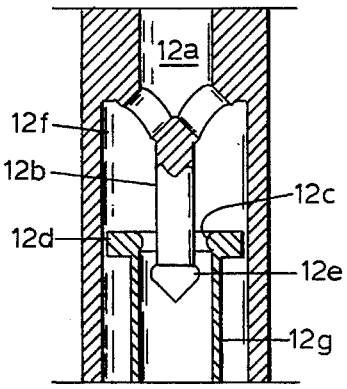
FIG. 7 is a symbolic, longitudinal section representing an area of FIG. 1 with an alternate feature.

FIG. 7 represents a symbolic replacement for the feature 8*a* if the sub is used above a drilling motor where no shaft 8 exists. Assembly 12*g* may be identical to assembly 2. Flange 12*d* and orifice 12*c* serve the function of elements 2*a* and 2*b* already described. Support 12*b* is suspended in opening 12*f* to position enlargement 12*e* such that it passes through orifice 12*c* to produce a drilling fluid pressure pulse when assembly 12*g* moves upward, as previously described, to actuate the sub to the deflected configuration.

Figure 8:
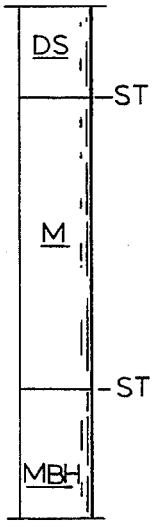
FIGS. 8, 9, and 10 are side elevations of a drill string length representing operational options presented by the sub when used both above and within a drilling motor body.
Figure 9:
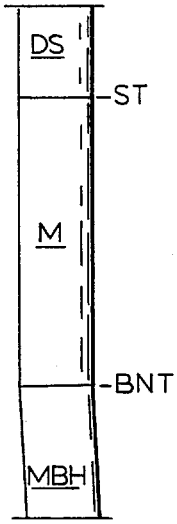
Figure 10:
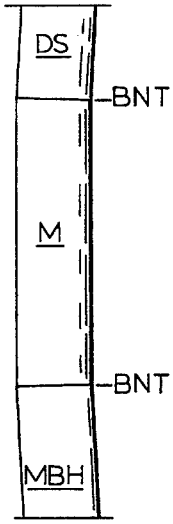
Figure 11:
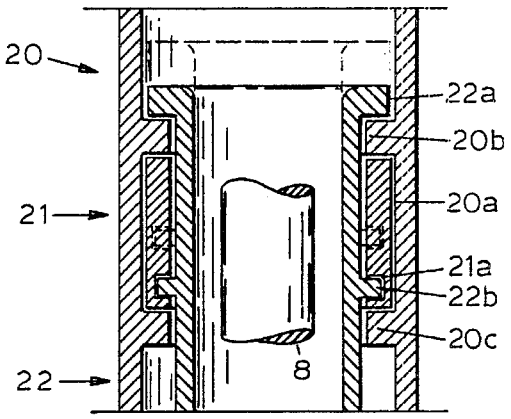
FIGS. 11 and 12 are side views, in cut away, of a selected area of FIGS. 1 and 2 respectively with an alternate form of selective controls.
Figure 12:
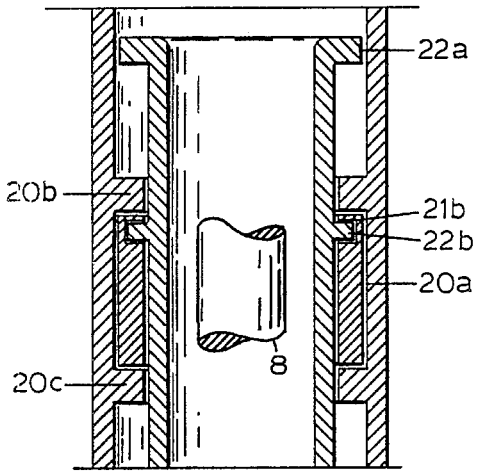
Figure 13:
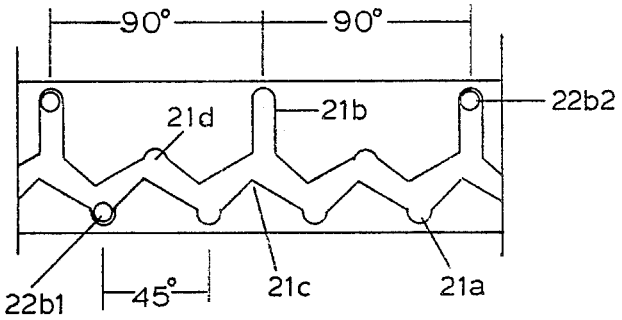
FIG. 13 is a surface development of part of the structure of FIGS. 11 and 12.

Description of FIGS. 8,9, and 10 will be deferred until FIGS. 11, 12, and 13 have been explained.

FIGS. 11 and 12 show only the area of the sub to be altered to utilize a turnstile control of the deflection feature. Body portion 20 has bore 20*a* to accept turnstile 21 between axial constraints 20*b* and 20*c*. Assembly 22 has cam pins 22*b* projecting to engage a serpentine groove, see FIG. 13, to rotate the turnstile one increment each time the assembly makes an up and down excursion. As shown in FIG. 13 the groove has peripherally spaced lodges typified by 21*a* occupied by pins 22*b* when the assembly 22 is in the down, or no-flow, position. In that position the pin is labeled 22*b*1. When the pin moves from an extreme position it engages a skewed wedge limit on the groove typical of 21*c* and is directed always in the same rotational direction which causes the turnstile to rotate. If the pin next arrives in lodge 21*d* on the next upward movement the pin and assembly is stopped before deflection takes place and drilling can continue in the straight configuration. On the next down and up excursion the pin enters elongated groove lodge 21*b* and the assembly can move up to change to the deflected configuration. The operation can be repeated endlessly and one such position for the pin is labeled 22*b*2. Two pins are shown but a greater number is preferred on larger subs. Shaft 8, if present, is unaltered. If pressure signals are to be generated, the bulge 8*a* and orifice 2*b* system can be directly adapted as previously described herein.

No spring is shown above flange 22*a*. Reverse circulation of drilling mud can be used briefly to force the assembly down to straighten the sub. No signal valve is shown but may be added to this assembly as previously described for FIGS. 1, and 2, or 7. There is normally a drag applied to the turnstile to prevent vibration wear. No drag is shown but it is normally an o-ring in a seal type groove about the periphery of the turnstile. 13 FIGS. 8, 9, and 10 show the deflection states available if the deflection sub is situated between a drill string DS and a drilling motor M and between the drilling motor M and the motors bearing housing MBH. FIGS. 1 and 2, as shown, represent the sub between motor M (portion 1) and the housing MBH (extension 9). Similarly, if portion 1 is directly connected to the drill string above the motor and extension 9 is directly connected to the top of motor housing M the principal difference is the absence of shaft 8 which can be replaced, optionally, by support 12*b* of FIG. 7. The drilling options available are the straight configuration of FIG. 8 with both subs straight (ST), bent motor housing only of FIG. 9 with the top sub straight (ST) and the lower sub bent (BNT), and both drill string bent and motor housing bent (BNT) of FIG. 10. The resulting generally curved stiffer down hole assembly can negotiate a greater rate of deflection of a well bore that a more flexible upwardly continuing drill string can follow through. The lock timer 5 is responsive to a drilling fluid flow rate established for each sub by its respective spring 5*h* and the sub above the motor can respond to a flow rate greater than that which actuates the lower sub. The turnstile and timer combination can also be used to the same end. The tandem sub arrangement can then be actuated, in either case, in sequence as the down hole assembly proceeds through the point of well bore deflection.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the sub of this invention without departing from the scope thereof, it is to be understood that all matter herein set forth or shown in the accompanying drawings is to be interpreted as illustrative and not in a limiting sense.

The invention having been described, I claim:

1. A deflection control sub for use as an element of a drill string for selecting straight or deflected configuration of the down hole assembly by particular manipulations of the surface drilling fluid controls, the sub comprising:

a) a generally tubular body with upper and lower portions bearingly connected for limited rotation therebetween, said upper portion having a first independent tubular: axis and said lower portion having a second independent tubular axis, said portions bearingly connected for said limited rotation about a third axis which is deflected a generally equal amount from said first and said second axes, the body having means at each end for fluid tight attachment to continuing drill string elements, and a fluid channel to conduct drilling fluid between said elements; and b) a fluid motor, drilling fluid powered and responsive to drilling fluid flow, situated in one of said portions with an output shaft connected no the other said portion to rotationally move said lower portion from a first rotational position to a preselected second rotational position relative to said upper portion;

whereby a drill string containing said sub can be installed in a well in a straight configuration and be changed to a deflected configuration when drilling fluid flow is established.

2. The sub of claim 1 wherein spring bias means is situated in said body arranged to provide rotational effort to oppose the direction of said limited rotation and to restore said first rotational position.

3. The sub of claim 1 wherein said motor comprises a hydraulic linear actuator which provides said limited rotation by rotational engagement of both said portions by axially sliding mating splined pairs having one helical pitch pair for one portion and a different helical pitch pair for the other portion.

4. The sub of claim 3 wherein spring bias means is situated in said body and arranged to provide axial force to said actuator to oppose the direction of said rotation and to restore said first rotational position.

5. The sub of claim 1 wherein said limited rotation between said portions is made responsive to signals from the surface by provisions of a time delay lock arranged to disable said motor in response to a first drilling fluid flow rate maintained for a preselected time interval, said first flow rate being less than a second higher drilling fluid flow rate required to actuate said motor, whereby said sub can permit drilling at said second flow rate in the straight configuration after said motor is disabled, and said sub can be caused to change to said deflected configuration by establishing said second flow rate before said interval has expired.

6. The sub of claim 1 wherein a variable flow restrictor is situated in said channel and arranged to briefly increase the resistance to fluid flow through said channel in response to said limited rotation in changing said sub between straight and deflected configurations whereby a brief pressure pulse appears as a signal at the surface fluid handling system to indicate configuration change in the sub.

7. The sub of claim 1 wherein said body portions comprise parts of a down hole drilling motor and said channel is arranged to accept a drilling motor drive shaft.

8. The sub of claim 1 wherein said configuration change is made responsive to surface manipulation of drilling fluid flow rate controls by mechanical selector switch means in said body, said switch comprising means responsive to selected movements of said motor to move to a new position on each occasion of said selected movements, at least one of said positions being on and at east one of said positions being off, said switch arranged to stop movement of said motor before said sub is changed to said deflected configuration when said switch is in said off position and said switch permitting said motor to move to change said sub to said deflected configuration when said switch is in said on position.

9. The sub of claim 3 wherein said switch comprises a turnstile element movable in rotational increments, each increment representing a said switch position, said response to said selected movements being provided by a cam carried by said actuator cooperating with a serpentine groove in said turnstile, said on position being provided by an axial groove extending from said serpentine groove to permit movement of said actuator sufficient to cause said sub to change to said deflected configuration, at least one said increment being said off position without said axial groove.

10. A deflection control sub for use as an element of a drill string for selecting straight or deflected configuration of the down hole assembly by particular manipulations of the surface drilling fluid controls, the sub comprising:

a) a generally tubular body with first and second portions bearingly connected for limited relative rotation therebetween, said first portion having a first independent tubular axis and said second portion having a second independent tubular axis, said portions telescoped together and bearingly connected for said rotation, between a first rotational position for straight drilling and a second rotational position for deflected drilling, about a third axis which is deflected a generally equal amount from said first and said second axes, the body having means at each end for fluid tight attachment to continuing drill string elements, and a generally central wash pipe to provide at least part of a drilling fluid channel to conduct drilling fluid between said drill string elements and to cooperate with a generally central opening in said body to provide an annular chamber for actuating machinery;

b) a hydraulic piston equipped cylinder situated for limited axial movement in said chamber with a tubular piston rod extending axially with two helical splines differing in helical angle, a first said spline rotationally engaging a first mating spline rotationally affixed to said first portion and a second said spline rotationally engaging a second mating spline rotationally affixed to said second portion; and c) fluid conduits in said body arranged to conduct fluid pressure from said channel to a first face of said piston and from outside the sub to a second face of said piston.

11. The sub of claim 10 wherein spring bias means is situated in said body arranged to provide rotational effort to oppose the direction of said rotation and to restore said first rotational position.

12. The sub of claim 11 wherein said spring is situated in said body to urge said piston to move to one limit of said axial movement and to oppose forces produced by said piston when drilling fluid pressure inside the sub exceeds fluid pressure outside the sub.

13. The sub of claim 10 wherein said wash pipe is axially movable to serve as said piston rod and is seatingly associated with the walls of said opening at two different diameters to provide at least one differential piston face to comprise said hydraulic cylinder.

14. The sub of claim 10 wherein said relative rotary movement between said portions is made responsive to signals from the surface by provisions of a time delay lock situated in said body to disable said motor in response to a first selected drilling fluid flow rate, less than a second higher drilling fluid flow rate required to actuate said motor, maintained for a preselected amount of time before said second flow rate is established for drilling, the lock comprising a fluid flow sensitive motor actuated lock responsive to said first fluid flow rate arranged to time out and lock said motor to prevent deflection of the sub, whereby said sub can permit drilling at said second flow rate in the straight configuration after the lock times out, and the sub can be caused to deflect by establishing said second flow rate for drilling before said lock times out.

15. The sub of claim 10 wherein a variable flow restrictor is situated in said wash pipe and arranged to briefly increase the resistance to fluid flow through said channel in response to movement of said motor in changing said sub between straight and deflected configurations whereby a brief pressure pulse appears as a signal at the surface fluid handling system to indicate configuration change in the sub.

16. The sub of claim 10 wherein said body portions comprise parts of a down hole drilling motor and the bore of said wash pipe is arranged to accept a drilling motor drive shaft.

17. The sub of claim 14 wherein said sensitive motor is a slow hydraulic cylinder and the run time for said time out is controlled by flow resistance to fluid displacement by movement of said slow cylinder, said lock comprising a plurality of interference elements movable by said slow cylinder at the time out position to produce axial mechanical engagement between said body, said elements, and said piston rod to prohibit axial movement of said rod.

* * * * *